US005400688A

United States Patent [19]

Eninger et al.

[11] Patent Number: 5,400,688

[45] Date of Patent: Mar. 28, 1995

[54] MISSILE DEFENSE SYSTEM

[75] Inventors: James E. Eninger; Peter D. Lohn, both of Torrance; H. Wilhelm Behrens, Rancho Palos Verdes, all of Calif.

[73] Assignee: TRW Inc., Redondo Beach, Calif.

[21] Appl. No.: 111,365

[22] Filed: Aug. 24, 1993

[51] Int. Cl.[6] ..... F41H 13/00

[52] U.S. Cl. ..... 89/1.11; 89/36.12

[58] Field of Search ..... 89/1.11, 1.13, 36.01, 89/36.12; 102/402, 403

[56] References Cited

U.S. PATENT DOCUMENTS

| | | | |
|---|---|---|---|
| 1,195,042 | 8/1916 | Leon | 89/1.11 |
| 2,979,015 | 4/1961 | Estes | 89/1.11 |
| 3,943,870 | 3/1976 | Paslay | 89/36.12 |
| 4,215,630 | 8/1980 | Hagelberg | 89/1.11 |
| 4,270,479 | 6/1981 | Baker et al. | 89/1.11 |
| 4,704,942 | 11/1987 | Barditch | 89/1.11 |
| 5,153,366 | 10/1992 | Lucas | 89/1.11 |

*Primary Examiner*—David Brown

[57] ABSTRACT

A missile defense system generates a change in density in the air path of a missile. The density change is created by a high-pressure water system which can be generated by a water jet or a body of water explosively created from a water surface. When operating against a waterborne missile, the density of the water medium is changed. The change in density creates an effective barrier against an incoming missile.

32 Claims, 8 Drawing Sheets

MISSILE DEFENSE SYSTEM

BACKGROUND

Providing an effective defense to incoming missiles directed at a target is vital.

This invention relates to a defense system against hostile missiles. In particular, it concerns a system for use by vessels located or moving on the surface of water.

One method of weaponry used against ships are sea-skimming missiles targeted at the ship. Such a missile is, for example, an Exocet missile, which has been used successfully in hostilities. Such missiles skim the sea at an altitude at about 10 meters and descend to about 3 meters above the surface of the sea before impacting the target.

Different techniques have been developed to intercept such missiles or disable such missiles prior to contact with the target. These techniques are not always successful such that a target is hit, and the result is disastrous.

The invention is directed to a system and method for defending against incoming missiles.

SUMMARY

This invention minimizes the disadvantages of known defense systems.

According to the invention there is provided a system for defending a target against an incoming airborne missile. The missile would be traversing a predetermined airborne path towards the target, and the path is at a low elevation.

The defense means includes means for generating in the airborne path of the missile and proximate the target a change in the density of the medium in the airspace. The space is removed from the target and a change in density is sufficient to effectively disable the missile relative to the target.

In a preferred form of the invention, a change in density is affected by developing a body of water in the airspace. The body of water can be generated by a high pressure jet directing water into the airspace. In an alternative form, the body of water can be generated by causing an explosion to occur below or on the surface, the surface being water. The explosion will cause a body, or wall of water to rise and such water would form a barrier of changed density in the path of the missile.

This increased density would effectively increase the aerodynamic load on the incoming missile. This can effect mechanical breakage of the missile, trigger or disable the fuse mechanism, the airbreathing engines or missile's aerodynamic control capability, or deflect the missile from the target. The significant dissipation of the kinetic energy is a primary cause of the missile's disablement.

Another aspect of the invention creates a shield for a moving target. A linear array of explosive devices moves relatively with the moving target to effect a moving shield for the moving target.

In another form of the invention, the defense system is operable against a sea borne missile, namely a torpedo. This would be effected by creating multiple explosions at spaced intervals relative to the target, at a predetermined time intervals relative to the path and speed of the torpedo. The multiple explosions would be triggered by sensor means at spaced intervals.

The invention is further described with reference to the accompanying drawings.

DRAWINGS

DESCRIPTION

Figure 1:
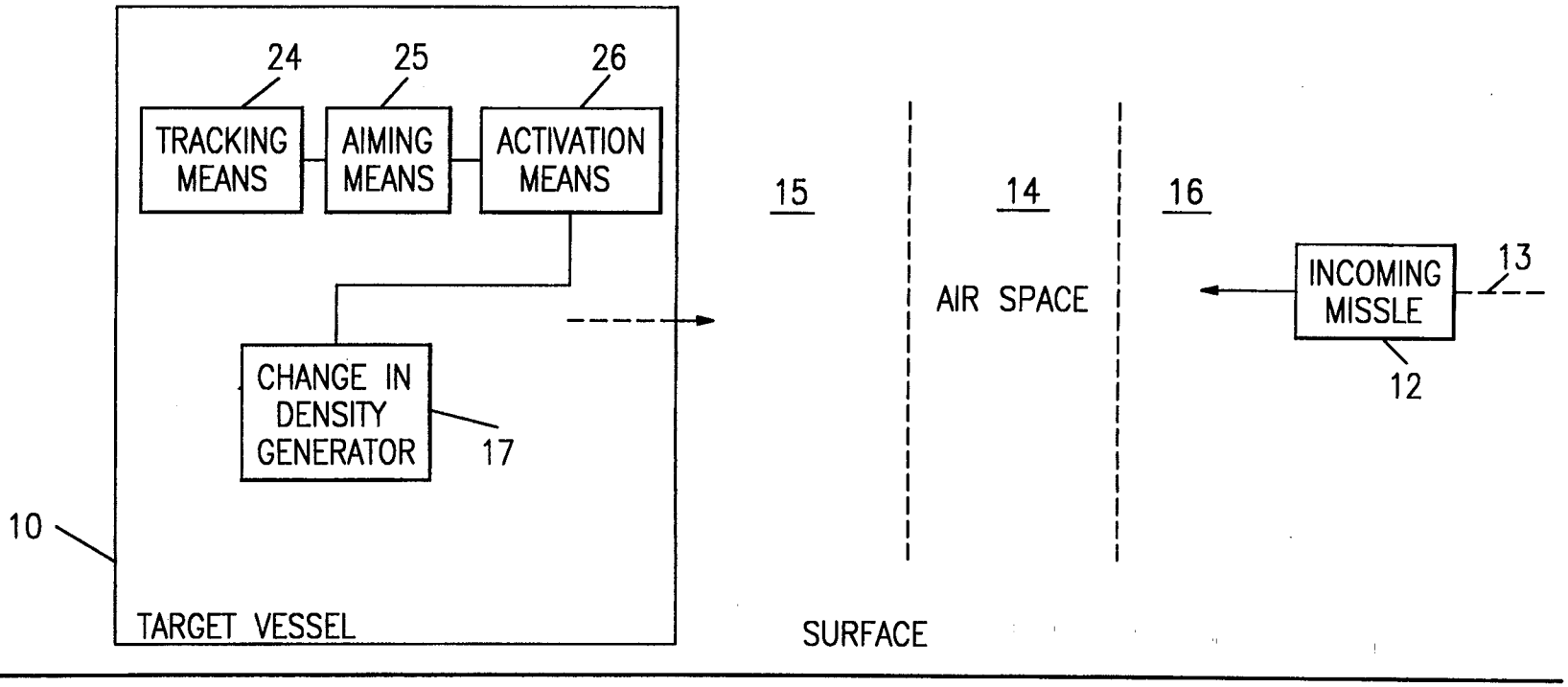
FIG. 1 is a block diagram illustrating the main components of the defense system.

Referring to FIG. 1 there is provided a system and method for defending a target vessel 10 in the nature of a ship or the like, floating or traversing on a water surface 11. When the target vessel 10 is under attack from an incoming missile 12, it is necessary to intercept, destroy, or disable the missile 12 before contact with the target vessel 10.

The missile 12 traverses an airborne path 13 at an elevation less than about 100 meters above the surface 11 of the water. The elevation may be at skimming level, for instance as low as 10 meters about the surface 11. Prior to contact with the vessel 10 the elevation may be in the range of about 3 meters above the surface 11. In other situations the missile may approach the vessel 10 from a very high elevation in a dive bombing path before reaching the vessel at the relatively low elevation.

Between the vessel 10 and the incoming missile 12 there is an airspace 14 which is to be traversed by the missile en route to the vessel 10. In the airspace 14 there is generated a change in the ambient density relative to the space 15 and 16 to either side of space 14. This change in density in the medium in the space 14 which is removed from the target 10 is sufficient to effectively disable the missile 12 relative to the target 10. The space 14 is proximate to the target 10.

Water Jets

Figure 2:
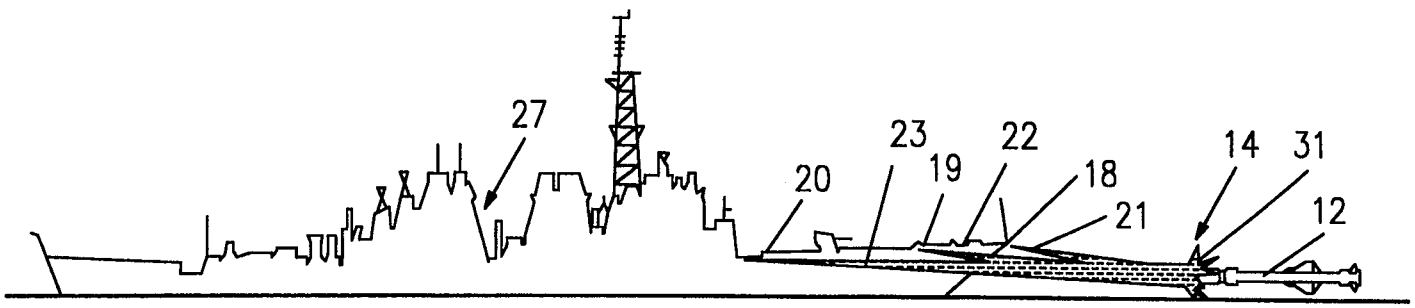
FIG. 2 is a diagrammatic view of a ship and missile with water jets mounted about the perimeter of the ship.

In FIG. 2 the means 17 for generating a change in density in the medium is mounted on the target vessel 10. It is operated in a manner to change the density by creating a body of water in the airspace 14. The generator 17 can be constituted by one or more water nozzles 18, 19 or 20 to direct jets of water 21, 22 or 23 into the airspace 14. The jets may be directed at a low elevation or at a higher elevation so as to impact the missile 12 as it traverses its trajectory 13.

The nozzles 18, 19 and 20 for developing high pressure auto jets 21, 22 and 23 are those used in mining, cutting and fire fighting. Such jets have an operating range of between 100–5,000 psi. Such a nozzle is used by TRW of Redondo Beach, Calif., the Assignee of the present application.

Tracking means 25 is provided for monitoring the trajectory or path 13 of the incoming missile 12. The tracking means 25 operates aiming means 24 for interacting with activating means 26 to operate the generator 17 through any one or more of the nozzles 18, 19 or 20.

In the embodiment illustrated in FIG. 2, the nozzles 18, 19 and 20 can be arranged about an entire perimeter of a ship 27. The nozzles are mounted on swivel or gimbal devices so as to be directed about and from the ship 27 as required. The generator 17 (in FIG. 1) operates the water jets so that water is ejected with sufficient nozzle pressure and volume to assure that it creates a wall of water in the airspace 14 and thereby protect the ship 27. By having the nozzles arranged to operate completely 360° about the ship 17, the vessel is effectively protected.

In FIG. 2 the water jets 21, 22 and 23 from the respective nozzles 18, 19 and 20 are directed at airspace 14. The jets can be controlled to create a water barrier in the path of the incoming missile 12 so that the missile will impact the region between the water jets and the head of the missile 12 if necessary, as the missile 12 advances towards the ship 27. Ideally, more than one of jets 21, 22 or 23 is focused at an impact point 31 for engagement with the missile 12. The jets can operate in a pulsating manner, criss-cross each other, intercept each other or otherwise be arranged so that a barrier is effectively created proximate to the vessel 12.

Water Wall

Figure 3:
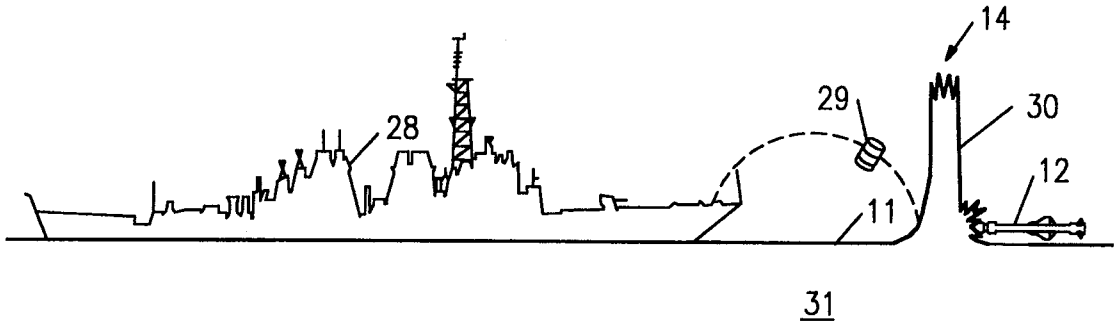
FIG. 3 is a diagrammatic view of a ship and missile and a projectile being directed into the water surface.

In FIG. 3, a different embodiment is shown for generating a change in density in the medium in the airspace 14. The ship 28 has projectile propelling means to project charges 29 into the water 31 at or below surface 11. The charges 29 detonate to create explosions in an area defined in space 14 so as to develop a wall of water 30 in front of the incoming missile 12. One or more of the charges 29 can be delivered into the water 31 to develop the water wall 30 which acts as the barrier to the incoming missile 12.

The wall 30 as shown in FIG. 3 can be generated in one or more location about the perimeter of the ship 28. As such, there may also be additional walls 30 located to either side of the space 14 and in a radial or circumferential position relative to that illustrated in FIG. 3.

The charges 29 are directed at spaced distances from each other. Also, the charges 29 can be timed to detonate at intervals to assure that one or more walls 30 can be developed.

Where the explosive system is used to develop the wall of water, appropriately charged explosives can be used to develop the wall. The appropriate guns and the like for propelling the charges can be used.

Missile Disablement

The invention provides for increasing the density in the airspace 14 to a level that is at least about ten times the normal or ambient air density. This is affected either by focusing a large degree of water projected from nozzles into the airspace, or by explosively raising a water wall in the airspace. This body of water should occupy a sufficient space to impact with a missile 12 skimming the surface of the sea at an altitude of at least between about 10 meters to 3 meters.

Water used to greatly increase the density in the space of the missile path effectively disables a missile 12. This is achieved by aerodynamically increasing the load on the missile 12. The load increases in proportion to the density increase. There is instantaneous amplification of load when the missile traverses the high density region and the missile will be stressed far beyond the design limits.

Such disablement caused by the increased density which affects the structure by any one or more of the following:

(a) triggering or disabling the fuse mechanism, (b) destroying the missile's aerodynamic control capability, (c) deflecting the missile from the target, (d) breaking up the missile.

The kinetic energy for destroying the missile 12 is provided by the missile itself. Missiles of the Exocet kind, which would be disabled with such a system, travel at a speed of Mach 0.9 and have a launch weight of about 670 kg. The fuse system is radar controlled. The impact and the guidance system for such missiles 12 is inertial and/or radar controlled. Destruction of the missile by the water barrier is relatively inexpensive and capable of being highly effective. Water such as seawater is of unlimited supply. Thus, the "ammunition" to effect missile destruction is obtained at no cost, is non-toxic, and non-polluting. By providing a large cross-section in the sense of a body of water or wall of water, the missile path is blocked over a large area. This renders the pointing and tracking requirements of the defense system for hitting a missile 12 less stringent than were the missile to be impacted by a specific projectile aimed towards a missile travelling at a high speed.

The system and method of the invention are useful for all-weather operations. By providing jets, nozzles or charge launchers spaced about the perimeter of the ship 27, the blackout areas not as well protected should be minimized.

Operational Parameters

Figure 4:
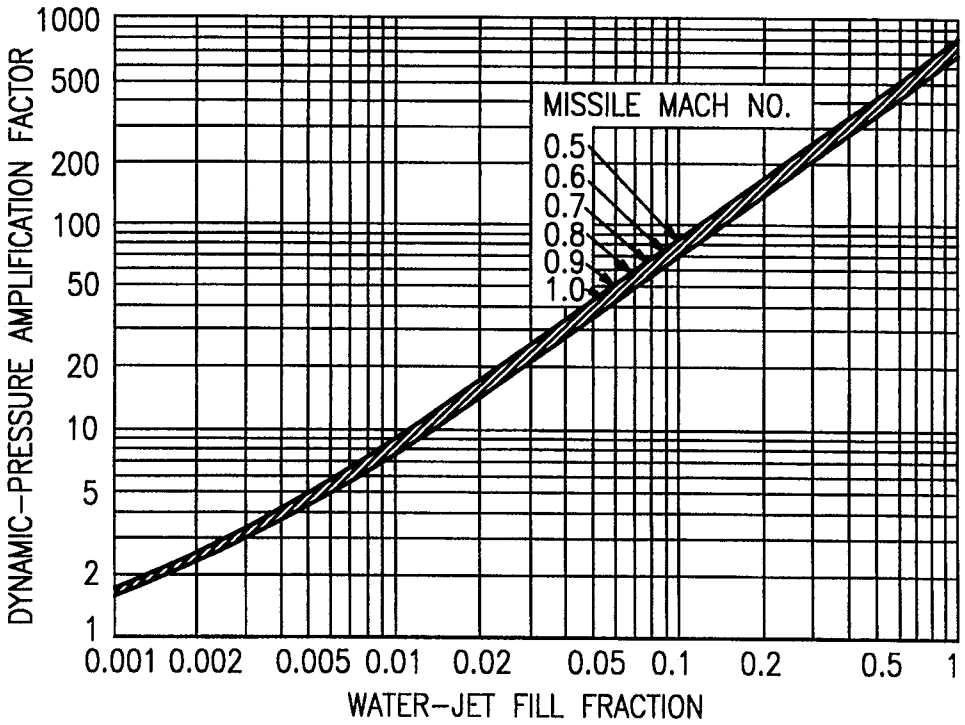
FIG. 4 is a graphical representation illustrating the dynamic pressure amplification generated by collision of a missile with a stationary sea water barricade.

As illustrated in FIG. 4, as the water jet fill fraction increases, the dynamic-pressure amplification factor increases when the missile impacts the water barrier. The fill fraction indicates the amount of water filling the airspace in the region of impact. The more water in a particular area, namely the greater the density in the area, the greater will be the dynamic pressure amplification.

Figure 5:
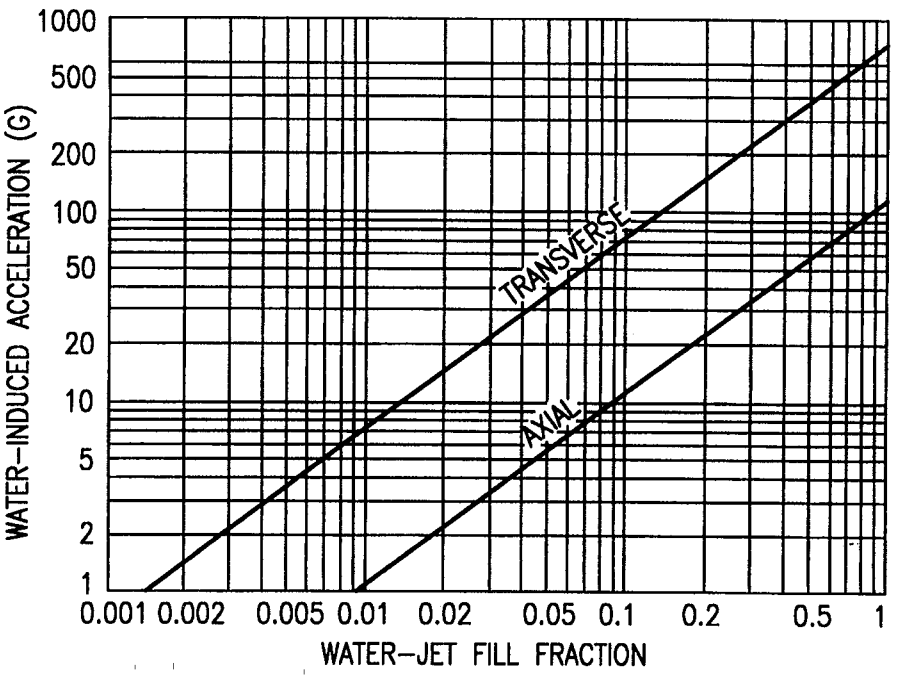
FIG. 5 is a graphical representation illustrating the effect of water-induced acceleration on a missile, generated by collision with a stationary sea water barricade.

As illustrated in FIG. 5, the axial and transverse accelerations on the missile would increase as the water jet fill fraction increases. The greater the amount of water in the airspace, the greater the transverse and axial acceleration on the missile.

Figure 6:
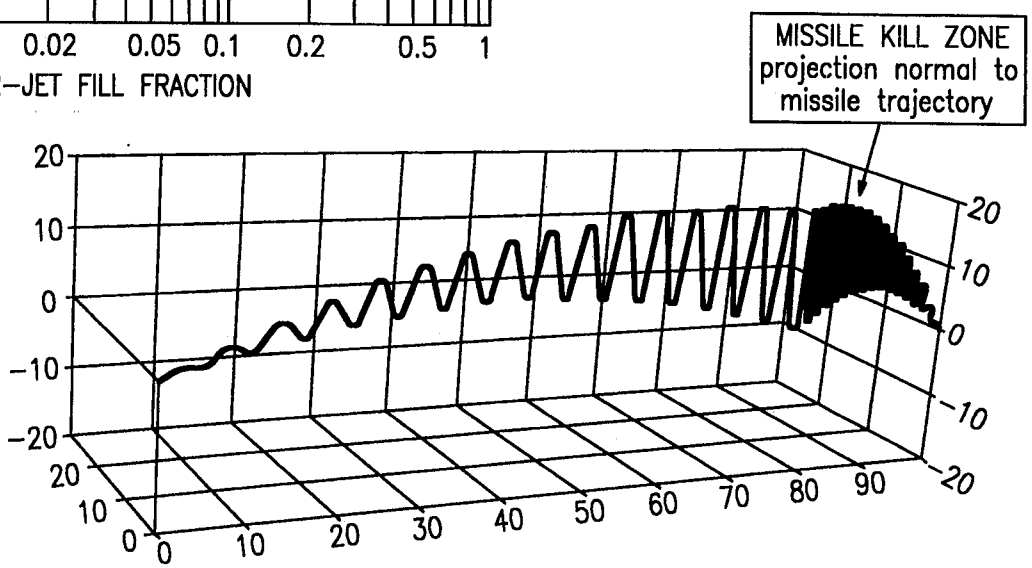
FIG. 6 is a graphical representation illustrating the effect of a water jet intercepting a missile at 15°.

As illustrated in FIG. 6, there is shown a missile kill-zone, which is normal to a missile trajectory. The water jet emanating from the nozzles has a vertical dither angle of about 5.7° in the vertical plane. The water jet intercepts the missile at about an angle of 15°. The dithering is computer-optimized in response to the tracking means and aiming means.

Figure 7:
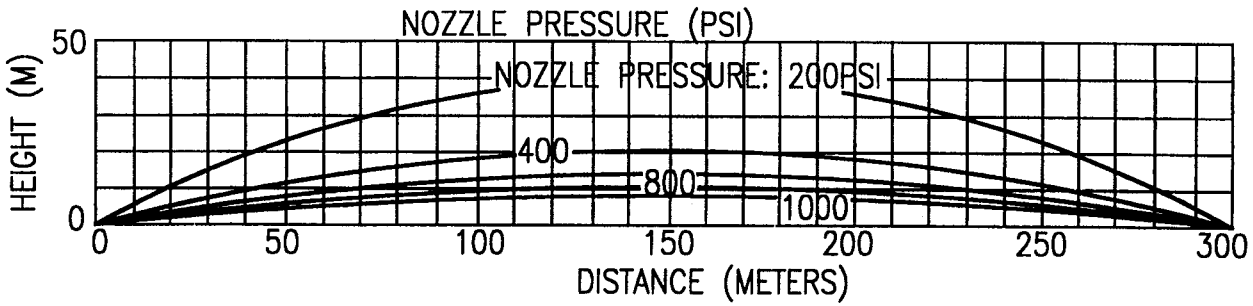
FIG. 7 is a graphical representation illustrating a water jet trajectory or different nozzle-supplied pressures.

FIG. 7 represents water jet trajectories for a 300 meter range. In such a situation, the airspace 14 is created at about 300 meters from the vessel. As indicated for different nozzle pressures varying between 200–1,000 psi, the range of 300 meters can be obtained having different trajectories of the water jet.

Figure 8:
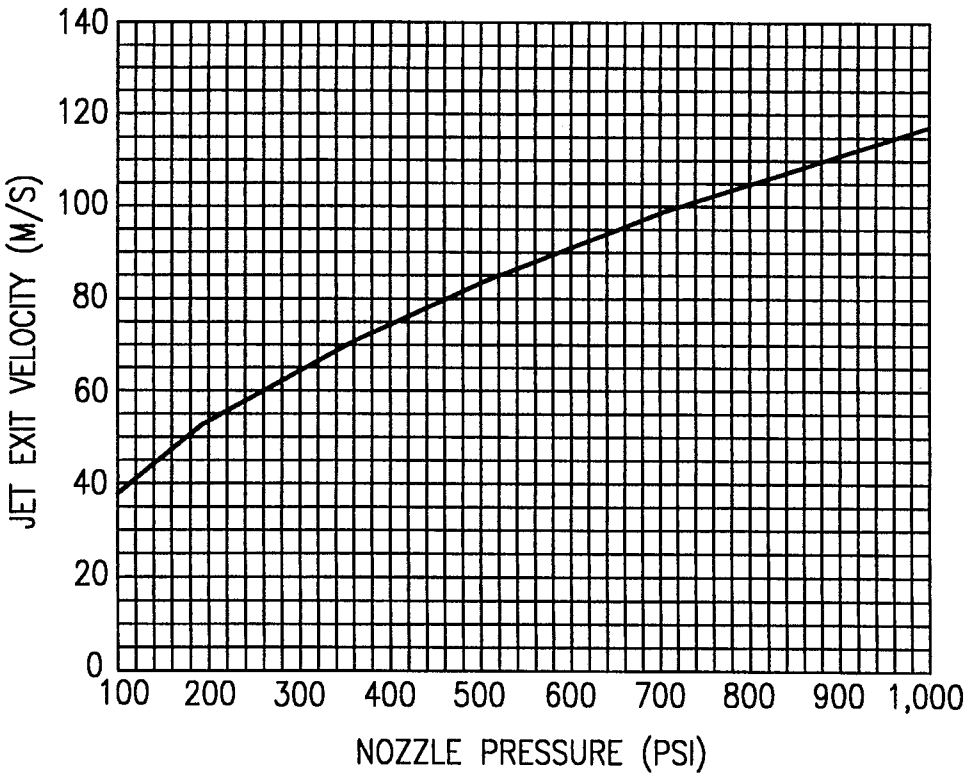
FIG. 8 is a graphical representation illustrating water jet exit velocity against pressure.

A relationship between the jet exit velocity and meters per second is plotted against the nozzle pressure psi and is represented in FIG. 8. The appropriate velocity and pressure is thereby obtained for a selected water jet.

Figure 9:
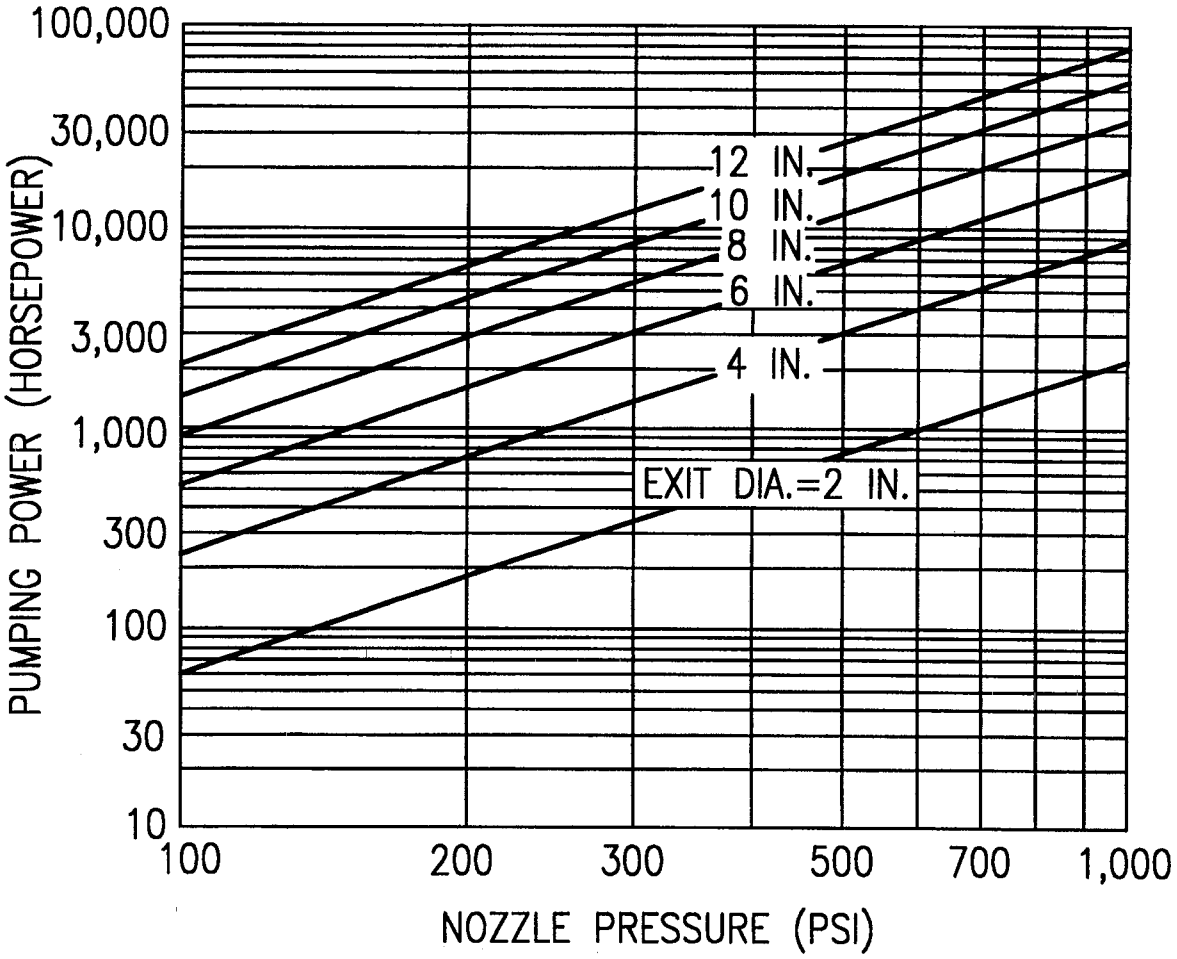
FIG. 9 is a graphical representation illustrating pumping power against pressure for various nozzle exit diameters.

As illustrated in FIG. 9, the nozzle pressure in psi varies according to the pumping power in horse power. Different nozzle exit diameters are illustrated as appropriate.

Figure 10:
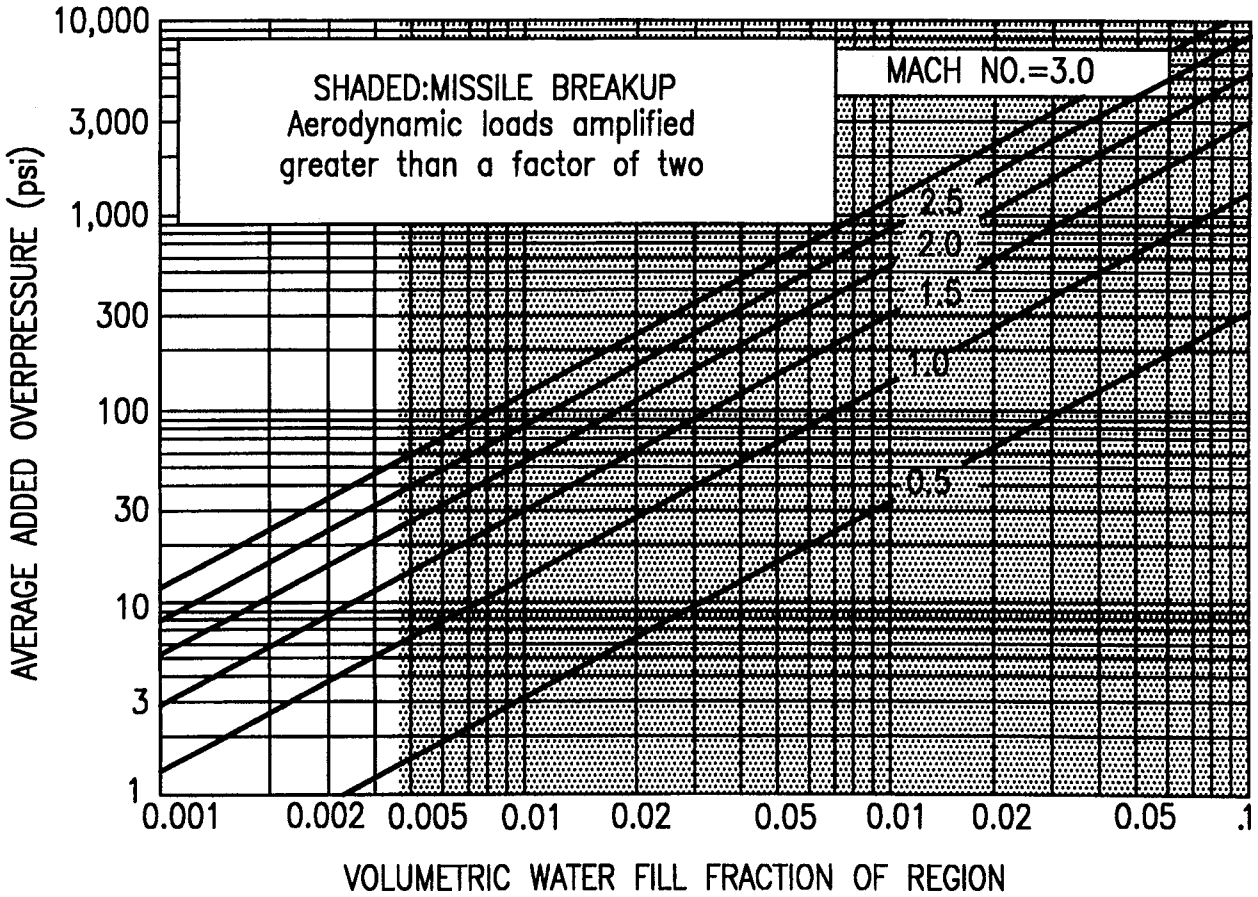
FIG. 10 is a graphical representation illustrating instantaneous overpressures generated on impact of a missile with a waterfilled region.

FIG. 10 represents the instantaneous over-pressures generated on impact of a missile with a waterfill airspace 14. There is plotted the average added over-pressure (psi) against the volumetric waterfill fraction of the region. The shaded areas in the graphical representation illustrate the missile breakup where the aerodynamic loads on the missile are amplified by greater than a factor of 2. The different diagonal lines represent the Mach number of the missile.

Figure 13:
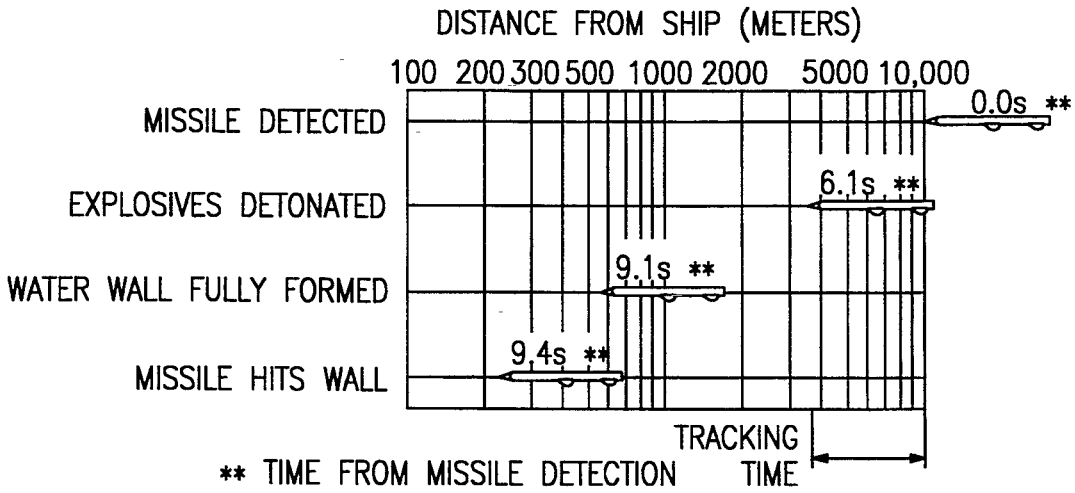
FIG. 13 is a timeline for a disablement of a Mach-3 missile detected at 10 kilometers.

FIG. 13 represents a timeline for using the water barrier generated by the explosive means for disabling a Mach-3 missile. The tracking time is illustrated as the number of seconds represented on top of each representative missile. The distance from the ship is illustrated in meters in relation to the condition when the missile is detected, explosive detonated, waterwall fully formed, and the missile hits the wall. The explosive can create plumes as high as 1000'.

Detection and Tracking

The detection and tracking system uses radar to acquire and track incoming missiles. The tracking data is sent to a pointing command sub-system. Such system can account for and adjust for the wind and ship movement and trigger firing commands to the water supply system in pointing commands to the nozzle sub-system.

A high pressure water supply sub-system supplies the appropriate high pressure to the nozzle. This can be a compressed gas-driven blowdown system and/or a high power continuous pumping system.

The nozzle subsystem can be a fast-response precision pointing means. Continuous aiming corrections can be applied relative to the ship roll and wind variations.

The detection and tracking system is similar to that used by the Phalanx radar directed gun. Such a system was developed by General Dynamics Corporation.

Figure 11:
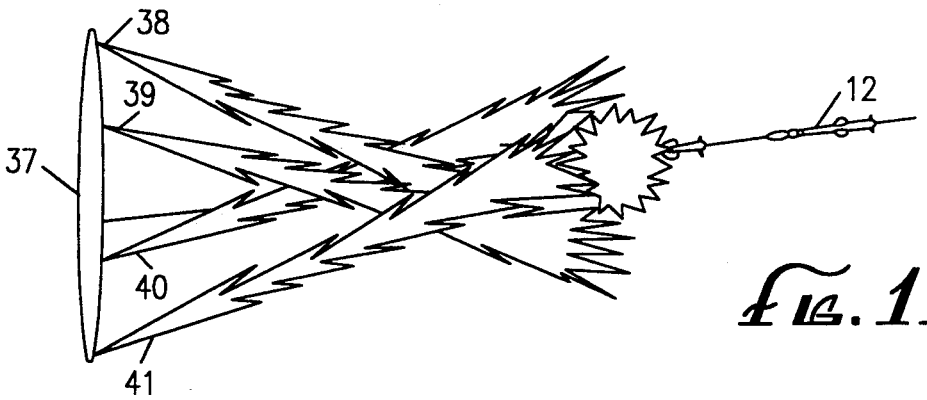
FIG. 11 is an indication of multiple high pressure water jets, each dithered vertically, creating an impenetrable sea water barrier to an incoming missile.

As indicated in FIG. 11, the vessel 37 has multiple jets 38, 39, 40 and 41, computer selected based on tracking data to direct their aim across a missile 12 incoming track. The missile 12 would breakup on impact with a waterfill region as indicated. The computer system for controlling the water jets 38, 39, 40 and 41 would optimize the system in terms of the variety of threats. Factors which would be taken into account are:

a. number of water jet nozzles, b. nozzle exit diameter and operating pressure, c. optimum Vertical dither amplitude and frequency, and d. optimum strategy for computer-control firing commands and aiming.

Targets

The target to be defended could be either a moving vessel 27 or a stationary structure such as an oil platform or other structures. The defense system would operate effectively where there is a good supply of water, and where the target is in or adjacent the water source such as a sea, ocean, lake or river. In other cases, the target could be located where there is a water reserve adjacent a structure located inland. Such a structure could be equally effectively defended by the defense system.

General

Many other forms of the invention exist, each differing from the other in matters of detail only.

Figure 12:
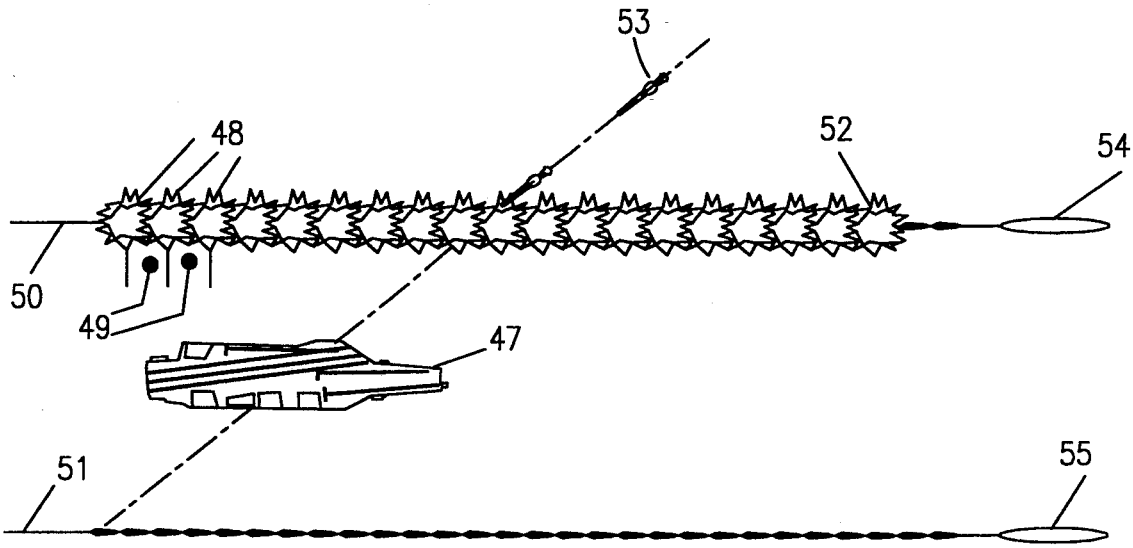
FIG. 12 is an illustration of a Nimitz class carrier protected by two linear arrays of submerged explosive charges towed by dedicated auxiliary craft.

As illustrated in FIG. 12, there is an implementation of the system for protecting a vessel 47. Charges 48 are located at spaced intervals 49 to either side 50 and 51 of the vessel 47. The charges 48 are streamlined to reduce the drag and have a hydrostatic-pressure-actuated diving plane to maintain arrays 52 on both sides of vessel 47 at an optimum depth.

When an incoming missile is detected along line 53, tracking the path is processed and commands are sent to detonate explosive charges 48 ahead of the missile. The explosives are in place in the water and are ready. A very time critical deployment can be met. Such timeline is illustrated in FIG. 13.

Towcraft 54 and 55 can move the arrays 52 through the water, and the crafts 54 and 55 can be manned or remotely piloted. The craft 54 and 55 themselves can be relatively invulnerable to missile attack. In this sense, they can operate submerged or have a very small radar cross-section using, for instance, Stealth technology. The craft 54 and 55 can be protected by high pressure water jets. The protection can be extended against multiple missile attacks.

Large water plumes have a "hang time" of nearly 10 seconds. Thus, a single barricade can be effective against a cluster of missiles spaced to several seconds apart. To handle missiles spaced further apart, several arrays 52 of explosives can be towed by one or more craft 54 and 55. The arrays 52 can be hardened against damage from detonation of any set of explosives. The angle of vulnerability from end-on shots is made small by increasing the length of the parallel linear array 52.

Figure 14:
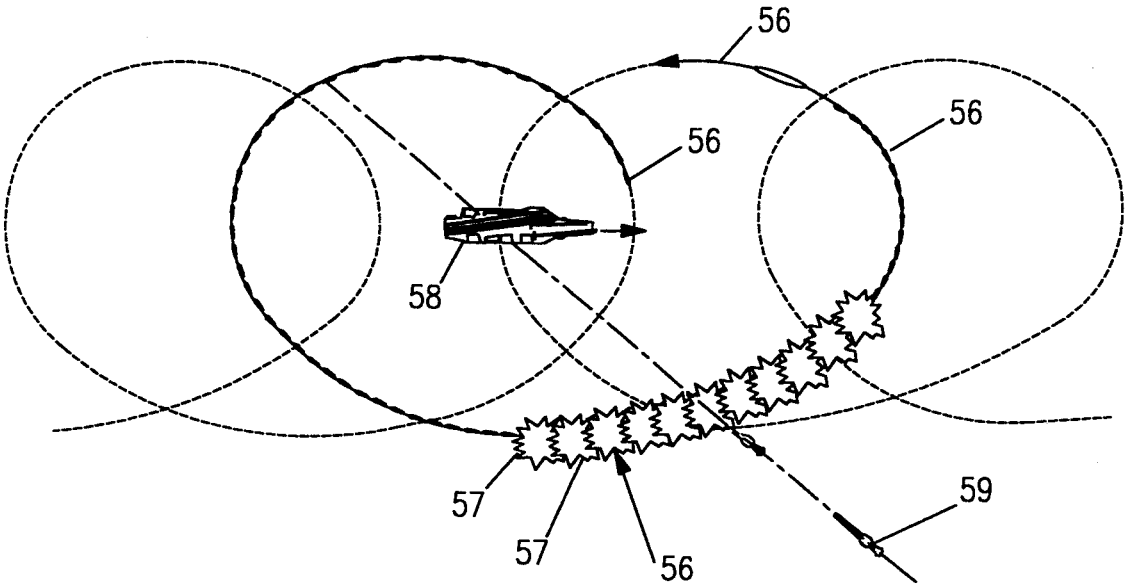
FIG. 14 is a representation of a 360° coverage provided by a single craft towing an array of charges around a vessel to be protected.

A different configuration is illustrated in FIG. 14. Complete coverage is possible with a single elongated array 56 of charges 57 towed around a vessel 58 as depicted in FIG. 14. For this approach, the vessel 58 travels relatively slow compared to the towed craft. The line of the missile path 59 would be traversed by the array line 56. Navigation would be carefully controlled with a GPS ship-movement data and real time computer analysis.

Figure 15:
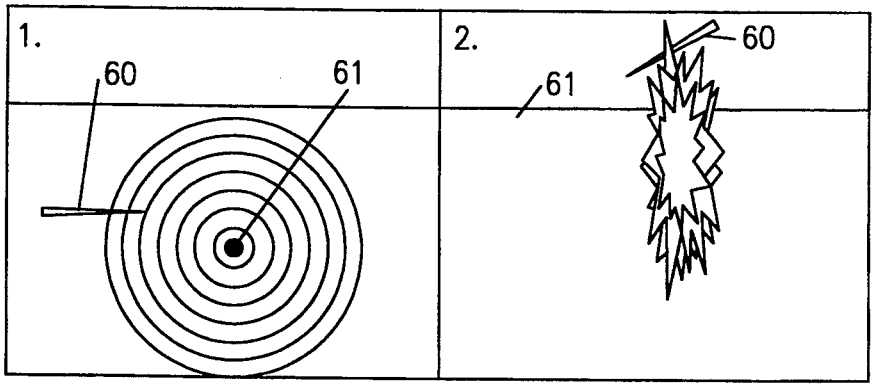
FIG. 15 is a representation of an end view of an array of explosive charges with active acoustic sensors for detonating a charge when a torpedo crosses the array.

As illustrated in FIG. 15, the towed array of explosive charges can defend against missiles such as torpedoes 60. The array would be equipped with active acoustic sensors ("pingers") 61. After the sonar of a ship detects an incoming torpedo, the acoustic sensors 61 activates selected charges when the torpedo 60 crosses the array as illustrated in timeframe 1 of FIG. 15. In the timeframe 2 of FIG. 15, the charges are exploded and the torpedo 60 is disabled.

The invention is to be determined solely by the following claims.

We claim:

1. A system for defending a waterborne target against an incoming airborne missile traversing a predetermined path in the air towards the target, the path being at an elevation above the water comprising means for generating a change in density in an airspace in the airborne path of the missile, the airspace being removed from the target and the change in density being sufficient to effectively disable the missile relative to the target, wherein the means for generating a change in the density in the path of the airborne missile includes means to discharge water into the airspace thereby to increase the density in the airspace.

2. A system as claimed in claim 1 wherein the means to discharge water into the airspace includes means for discharging an explosive in the water adjacent to the airspace, the explosive causing water to rise from the water's surface to occupy the airspace.

3. A system as claimed in claim 1 wherein the target is located adjacent to or on water, and the target includes the means to discharge water into the airspace.

4. A system as claimed in claim 1 wherein the target is a vessel floating on water and the vessel includes the means to discharge water in the airspace.

5. A system as claimed in claim 1 wherein the means to discharge water into the airspace includes means for generating a high pressure water jet in the airspace.

6. A system as claimed in claim 1 wherein the means to discharge water includes means for generating a body of water in the airspace, the airspace being proximate the target and the body of water acting to create a barrier to the incoming missile.

7. A system as claimed in claim 6 wherein the means for generating a body of water in the airspace includes means for increasing the density of the space at least about ten times a normal density of air in the airspace.

8. A system as claimed in claim 1 including means for detecting and tracking the path of the missile, means for transmitting tracking information to the means for generating a change in density, and means for activating the means for generating the density change in response to a determination of the missile being in a predetermined trajectory on the path, and including means for aiming the means for generating the change in density at a predetermined location in the path of the incoming missile.

9. A system as claimed in claim 8, wherein the means to discharge water into the airspace includes means for generating a water jet.

10. A system as claimed in claim 8 including multiple means for generating a change in density, the multiple means being located about the target, and means for targeting at least one of the means for generating a change in the density such that the change in density would be developed at a predetermined point in the path of the missile.

11. A system as claimed in claim 10 wherein the means to discharge water into the airspace includes means for generating a water jet.

12. A system as claimed in claim 11 including multiple means for generating a water jet, and wherein the aiming means directs the multiple means for generating a water jet at the predetermined location.

13. A system for defending a target against an incoming airborne missile traversing a predetermined path in the air towards the target, comprising means for generating a change in density in an airspace in the airborne path of the missile, the airspace being removed from the target and the change in the density being sufficient to effectively disable the missile relative to the target wherein the means for generating the change in density includes a means for detonating an explosive charge thereby to generate an explosion in water and cause a body of water to occupy the airspace.

14. A system as claimed in claim 13 including multiple explosive charges, the charges being located in spaced relationship with each other.

15. A system as claimed in claim 14 wherein the target is movable; and including means for moving the multiple explosive charges in relation to the target to at least partly embrace the target.

16. A system as claimed in claim 15 including means for detonating selected explosive charges to develop the change in density.

17. A system as claimed in claim 14 wherein the multiple explosive charges are arranged in a layout in respect to the target, the layout at least partly embracing the target.

18. A system as claimed in claim 17 including means for detonating selected explosive charges to develop the change in density.

19. A system for defending a target in or adjacent to a body of water against an incoming airborne missile traversing a predetermined path in the air towards the target, comprising means for generating a change in the density in an airspace medium in the airborne path of the missile, the airspace being removed from and proximate to the target and the change in the density being sufficient to effectively disable the missile relative to the target including means for generating a high pressure jet of water in the airspace, the high pressure of the water in the airspace increasing the density of the medium at least about ten times the normal density of the medium.

20. A system as claimed in claim 19 including means for tracking the path of the missile, means for transmitting the tracking information to the means for generating a change in density, and means for activating the means for generating the density change in response to a determination of the missile being in a predetermined trajectory on the path, and including means for aiming the means for generating the change in density at a predetermined location in the path of the incoming missile.

21. A method of defending a target against an incoming airborne missile traversing a predetermined path in the air towards the target, the path being at an elevation above a surface comprising generating a change in the density in an airspace in the airborne path of the missile, the airspace being removed from and proximate to the target and the change in the density being sufficient to effectively disable the missile relative to the target.

22. A method as claimed in claim 21 wherein the surface is water and including discharging an explosive from the water adjacent to the space, the explosive causing water to rise from the surface to occupy the airspace.

23. A method as claimed in claim 21 including discharging water into the airspace thereby to increase the density of the airspace.

24. A method as claimed in claim 21 including generating a high pressure water jet in the airspace.

25. A method as claimed in claim 21 including tracking the path of the missile, transmitting the tracking information and activating and generating the density change in response to the determination of the missile being in a predetermined trajectory on the path, and including locating the change in density at a predetermined location in the path of the incoming missile.

26. A method as claimed in claim 21 including generating a body of water in the airspace.

27. A method as claimed in claim 26 wherein generating the body of water in the airspace includes increasing the density of the space at least about ten times the normal density of the air.

28. A method as claimed in claim 21 herein generating the change in density includes detonating an explosive charge thereby to generate an explosion in water and cause a body of water to occupy the airspace.

29. A method as claimed in claim 28 including generating multiple explosive charges, the charges being located in spaced relationship with each other.

30. A method as claimed in claim 29 wherein the target is movable; and the multiple explosive charges are moved in relation to the target to at least partly embrace the target.

31. A method as claimed in claim 29 including arranging the multiple explosive charges in a layout in respect to the target, the layout at least partly embracing the target.

32. A method as claimed in claim 29 wherein selected explosive charges are detonated to develop the change in density.

* * * * *